US007095599B2

(12) United States Patent
Maekawa et al.

(10) Patent No.: US 7,095,599 B2
(45) Date of Patent: Aug. 22, 2006

(54) FUEL INJECTOR AND ITS CONTROL METHOD

(75) Inventors: Noriyuki Maekawa, Chiyoda (JP); Motoyuki Abe, Chiyoda (JP); Makoto Yamakado, Tsuchiura (JP); Toru Ishikawa, Kitaibaraki (JP); Kooji Shibata, Sapporo (JP)

(73) Assignee: Hitachi, Ltd., Tokyo (JP)

( * ) Notice: Subject to any disclaimer, the term of this patent is extended or adjusted under 35 U.S.C. 154(b) by 234 days.

(21) Appl. No.: 10/759,250

(22) Filed: Jan. 20, 2004

(65) Prior Publication Data

US 2005/0073795 A1 Apr. 7, 2005

(30) Foreign Application Priority Data

Oct. 7, 2003 (JP) ..... 2003-347841

(51) Int. Cl.
*H01H 47/00* (2006.01)
*H01H 47/28* (2006.01)
*H01H 47/32* (2006.01)

(52) U.S. Cl. ..... 361/152; 361/139

(58) Field of Classification Search ..... 361/152, 361/139

See application file for complete search history.

(56) References Cited

U.S. PATENT DOCUMENTS 5,293,076 A * 3/1994 Fukui ..... 290/40 C
6,120,005 A * 9/2000 Wright ..... 251/129.1
2002/0166541 A1 11/2002 Yamakado et al.

FOREIGN PATENT DOCUMENTS

| | | |
|---|---|---|
| EP | 0 6193 756 A | 1/1996 |
| JP | 8-45735 | 2/1996 |
| WO | WO 00/14395 A | 3/2000 |

* cited by examiner

*Primary Examiner*—Brian Sircus
*Assistant Examiner*—Dharti H. Patel
(74) *Attorney, Agent, or Firm*—Antonelli, Terry, Stout and Kraus, LLP.

(57) ABSTRACT

When voltage changes occur in the battery used as a power supply in a fuel injection system, the amount of fuel injection also changes and the required amount of fuel injected cannot be obtained. To eliminate this problem, a fuel injector system is provided which has a fuel injection valve with at least one coil, a power supply, a power supply voltage detector, and a control unit for controlling the fuel injection valve. The control unit sets a reference value of a power supply voltages, and the above-mentioned fuel injection valve is controlled so as to obtain the required ampere-turns by reducing the resultant inductance of the coil when a power supply voltage detection value is less than the above-mentioned reference value, and the resultant inductance of the coil is increased when the power voltage detection value is greater than the reference value.

5 Claims, 7 Drawing Sheets

| | POWER VOLTAGE $V_{103}$ | |
|---|---|---|
| | NORMAL $V_{103} > V_{th}$ | TOO LOW $V_{103} \leqq V_{th}$ |
| FIRST SWITCH (105) | on | off |
| SECOND SWITCH (106) | off | on |
| THIRD SWITCH (107) | off | on |
| FIRST AND SECOND COILS (100,101) | SERIES | PARALLEL |
| TARGET VALUE OF CURRENT CONTROL UNDER RETENTION MAGNETOMOTIVE FORCE | I | $2I = (I_1 + I_2)$ |

FUEL INJECTOR AND ITS CONTROL METHOD

BACKGROUND OF THE INVENTION

The present invention relates to a fuel injector system having a fuel injection valve, which is mounted in an internal-combustion engine to control the amount of fuel supplied to the engine, and to a method of controlling the fuel injection valve.

In general, a fuel injection valve comprises a fuel injection orifice, a valve seat disposed in the vicinity of the fuel injection orifice, a valve body slidably supported in an axial direction at the position facing the valve seat, and a spring. The spring generates a force that presses the valve body in the direction of and into contact with the valve seat so as to close the valve orifice. Thus, while the valve seat and the valve body are kept in contact by the spring force, that is to say, in the closed status of the valve, since the fuel passageway through the fuel injection orifice is closed, fuel is not injected from the fuel injection valve.

The fuel injection valve also has a magnetic circuit and coil assembly for driving the valve body. The application of a current to the coil assembly exerts a magnetic attraction force on the valve body, causing the valve body to slide in an axial direction and move away from the valve seat, thereby to open the fuel passageway through the fuel injection orifice. At this time, since the fuel passageway is opened, fuel is injected from the fuel injection valve.

In the operation of such a fuel injection valve, the amount of fuel supplied can be controlled by adjusting the time during which the open status of the valve is maintained. To precisely control the amount of fuel supplied to the internal-combustion engine, it is necessary to reduce the minimum amount of injection that represents the minimal value of the controllable amounts of fuel capable of being supplied. To achieve such a reduction, the valve body needs to be opened at high speed, and, for this purpose, the supply of current to the coil assembly needs to be rapidly started.

A patent document 1 (Japanese Application Patent Laid-Open Publication No. Hei 08-45735) exemplifies the conventional technology related to the above-described fuel injection valve operation.

According to the patent document 1, in an electromagnetic load-driving method that uses at least one series circuit, which includes a load and a changeover means, changeover control is provided so that supply of a current to the coil assembly can be rapidly started by setting a small resultant inductance for a first time interval, in other words, for valve opening, and a large resultant inductance is then set for a second time interval, which represents the valve-opening retention duration, following the above-mentioned first time interval.

SUMMARY OF THE INVENTION

Under the conventional technology described above, the resultant inductance is changed in value between the first time interval and the second time interval. More specifically, the resultant inductance is changed from a low value to a high value, between the first time interval for which the starting time of supply of the current is to be minimized, and the second time interval for which, although a hold current is required, an excessively fast responsiveness is not required. In such a system, no problems would occur so long as the power supply voltage does not change.

However, in particular, when the power supply actually used is a battery, voltage changes cannot be avoided. A fuel injector needs to operate its valve body at high speed and stably, even when the power supply voltage changes. For this reason, a greater magnetomotive force, in other words, a larger integer value of the ampere-turns within the required time, is preferable. However, in the case of the patent document 1 mentioned above, no consideration is given to changes in magnetomotive force which result from changes in the power supply voltage.

An object of the present invention is to provide: a fuel injector system in which changes in the amount of injection from its fuel injection valve can be suppressed and the above-described problems can be solved by operating the valve body at high speed and stably, even when power supply voltage changes occur, thereby to obtain stable fuel injection characteristics.

It is another object of the present invention to provide an improved method of controlling the operation of a fuel injector.

In accordance with the present invention, in which high-speed and stable operation of a valve body of a fuel injector is achieved by providing connection changeover control of the coils, when power supply voltage changes occur in the coil-equipped fuel injection valve, the problems described above can be solved.

In a fuel injector system that comprises a direct-current power supply, a power supply voltage detection means, a coil-equipped fuel injection valve, and a control unit for controlling said fuel injection valve, the control unit outputs a changeover signal for changing the magnitude of the resultant inductance of the coil in accordance with a power supply voltage detection value received from the power voltage detection means.

Also, in accordance with the present invention, a reference value of the power supply voltage is set beforehand, and the control unit outputs a control signal so that when a detected power supply voltage value is less than the foregoing reference value, the resultant inductance of the coil is reduced, and when the detected power supply voltage value is greater than the foregoing reference value, the resultant inductance of the coil is increased.

In addition, in accordance with the present invention, the fuel injection valve has a plurality of coils, and when the resultant inductance is to be set to a large value, the above-mentioned plurality of coils are connected in series, and when the resultant inductance is to be set to a small value, the above-mentioned plurality of coils are connected in parallel.

According to the present invention, even when power supply voltage changes occur, it is possible to operate the valve body at high speed and stably and to stabilize the amount of fuel injection with respect to the same injection command pulse width. Accordingly, it is possible to provide a fuel injector that can stabilize the operational status of an internal-combustion engine.

DESCRIPTION OF THE INVENTION

In a fuel injector system that comprises a direct-current power supply, a power supply voltage detection means, a coil-equipped fuel injection valve, and a control unit for controlling the fuel injection valve, the fuel injection valve has a plurality of coils, and the control unit outputs a changeover signal for changing the magnitude-of-resultant inductance of the plurality of coils of the fuel injection valve in accordance with a power supply voltage detection value received from the power supply voltage detection means.

The control unit is also adapted to set a reference value of a power supply voltage beforehand and to output a changeover signal by which, when a value that has been detected by the power supply voltage detection means is less than the reference value that has been set beforehand, the resultant inductance of the coils is reduced, and when the power supply voltage detection value is greater than the reference value, the resultant inductance of the coils is increased.

Figure 1:
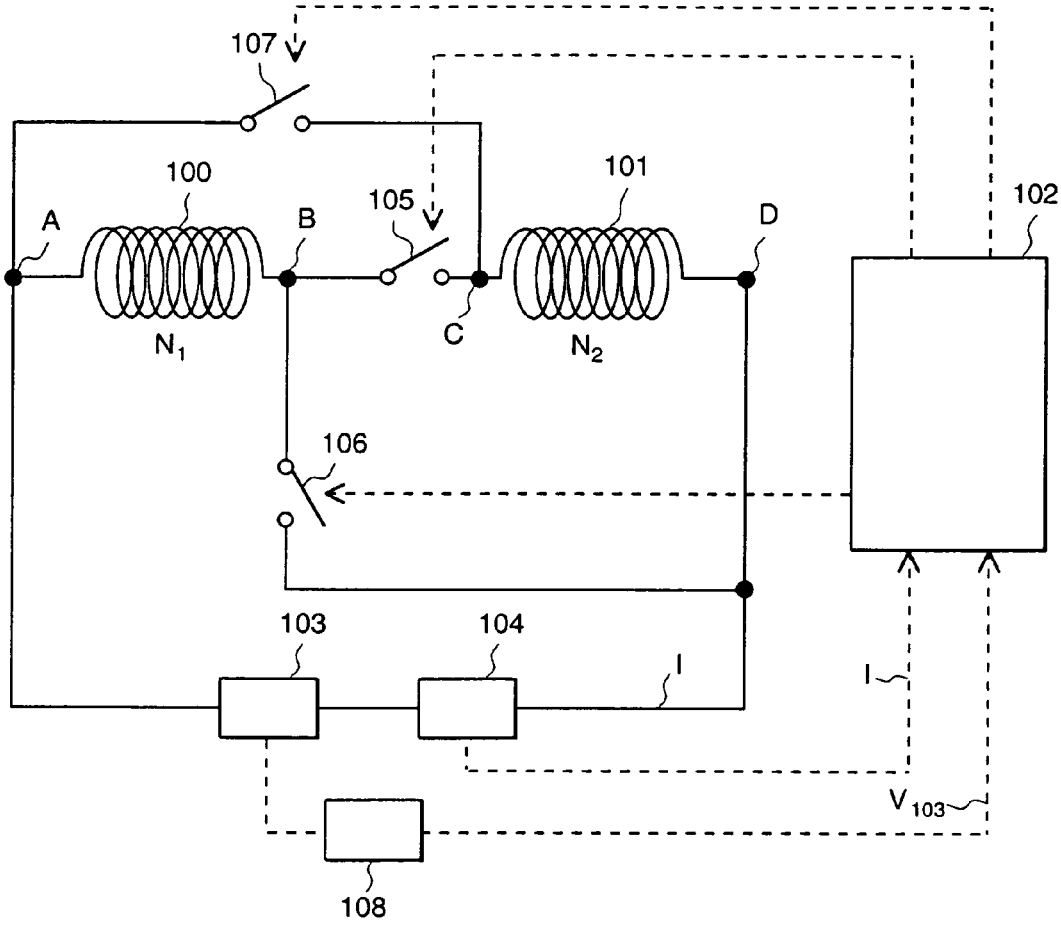
FIG. 1 is a block circuit diagram representing an embodiment of the fuel injector system according to the present invention.
Figure 2:
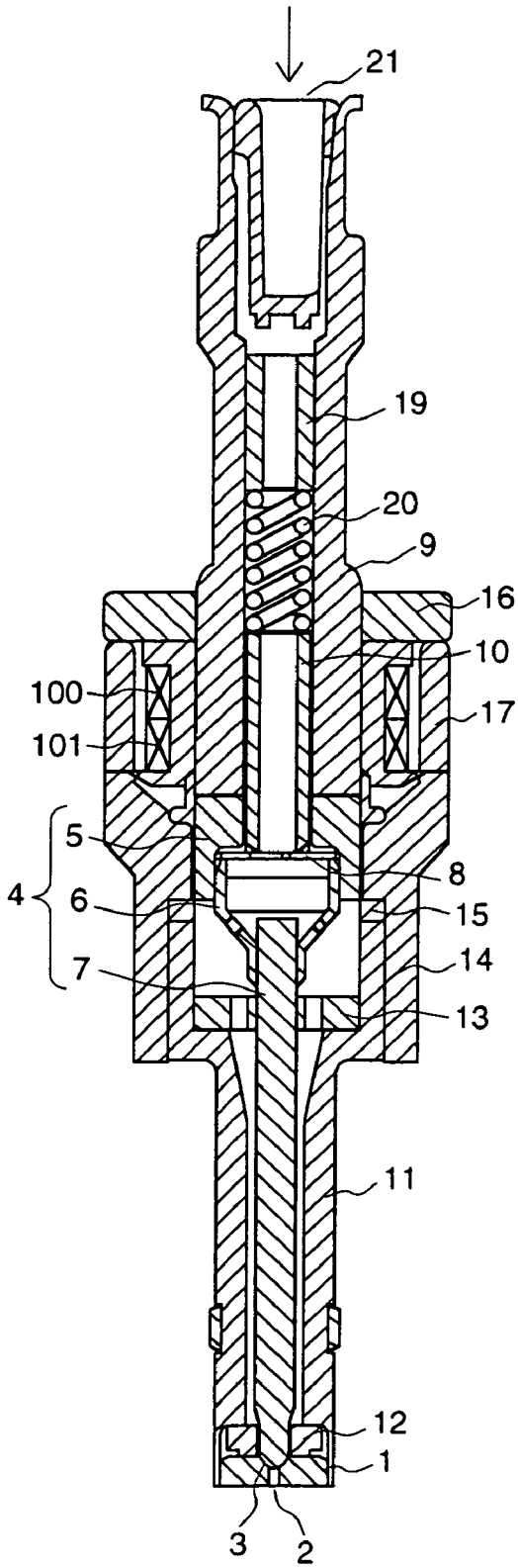
FIG. 2 is a cross-sectional view representing an embodiment of the fuel injection valve constituting the fuel injector of the present invention.

FIG. 1 is a block diagram representing an embodiment of the fuel injector system according to the present invention. FIG. 2 shows an example of the composition of the fuel injection valve constituting the principal element of the fuel injector system to which the present invention applies.

First, the basic operation of the fuel injection valve will be described with reference to FIG. 2, which is a cross-sectional view showing an example of the type of fuel injection valve to be used in the fuel injector system of the present invention. An orifice plate 1 is provided with a fuel injection orifice 2 and a valve seat 3. The orifice plate 1 is fixed to an end portion of a nozzle holder 11, such as by welding. A fuel swirler 12 for swirling fuel is provided between the orifice plate 1 and the nozzle holder 11.

Also, a guide plate 13 is fixed inside the nozzle holder 11. A valve body 4 is guided in reciprocal sliding movement by a hole provided in the center of the guide plate 13 and by an inside-diameter section of the swirler 12. The valve body 4 comprises a movable iron core 5, a tubular member 6, and a rod 7, all of which are connected, such as by welding. A damper plate 8 provided inside the movable iron core 5 has an outer-surface section that is supported by an upper edge of the tubular member 6. An interlocking member 10 is slidably supported in an axial direction inside an inner fixed iron core 9. The interlocking member 10 has an internal end that is brought into contact with an inner-surface section of the damper plate 8. The damper plate 8 has its outer-surface section fixedly supported, and its inner-surface section is axially warped, thereby functioning as a plate spring.

The nozzle holder 11 is fixed to the inside of a nozzle housing 14. A ring 15 for adjusting the stroke of the valve body 4 is provided at an upper end of the nozzle holder 11. A spring pin 19 is fixed inside the inner fixed iron core 9. With a lower end of the spring pin 19 serving as its fixed upper end, a spring 20 is provided in a compressed condition inside the inner fixed iron core 9.

Numeral 21 denotes a fuel supply port. Spring force from the spring 10 is transmitted to the valve body 4 via the interlocking member 10 and the damper plate 8, and the rod 7 of the valve body 4 is pressed against the valve seat 3. Under this closed status of the valve, since the fuel passageway is closed at the fuel injection orifice 2, fuel that has been supplied from the fuel supply port 21 stays inside the fuel injection valve, and thereby, fuel is not injected from the fuel injection orifice 2.

A magnetic circuit disposed around a first coil 100 and a second coil 101 is constituted by the nozzle housing 14, the movable iron core 5, the inner fixed iron core 9, a plate housing 16, and an outer fixed iron core 17.

When an injection command pulse turns on, a current flows into a series circuit formed by the first coil 100 and the second coil 101, so that the movable iron core 5 is attracted to the inner fixed iron core 9 by electromagnetic force, and the valve body 4 moves to a position at which its upper edge comes into contact with the lower edge of the inner fixed iron core 9. Under this open status of the valve, since a clearance is created between rod 7 of the valve body 4 and the valve seat 3, the fuel passageway is opened and fuel that has been supplied from the fuel supply port 21 is swirled by the swirler 12 and injected from the fuel injection orifice 2.

When the injection command pulse turns off, the flow of the current into the first coil 100 and the second coil 101 is stopped, and since the electromagnetic force disappears, the valve body 4 returns to a closed status in which the valve body 4 slides downward until the rod 7 comes into contact with the value seat 3 in response to the spring force to terminate the injection of the fuel.

The function of the fuel injection valve is to control the amount of fuel supplied, by changing the position of the valve body 4 between an open status and a closed status, depending on the injection command pulse status, to adjust the retention time of the open valve status. To precisely control the amount of fuel supplied to an internal-combustion engine, it is important that the amount of fuel injection with respect to the same injection command pulse width should always be stable.

An embodiment of the fuel injector system according to the present invention will be described below with reference to FIG. 1.

In FIG. 1, a power supply 103 and a current detector 104, together with a first switch 105, a second switch 106, and a third switch 107, are connected to a first coil 100 of a fuel injection valve and to a second coil 101 thereof. The power supply 103 here can be either a battery mounted in a vehicle or a high-voltage generator consisting of a combination of a battery and a booster circuit which includes, for example, a DC/DC converter. The power supply can be any device, provided that it can supply electric power to the fuel injection valve. To make the fuel injection system less expensive, however, it is preferable that the power supply be in the form of a battery for a vehicle.

Although it is preferable that the current detector 104 be of the type which uses a current detection resistor, the type of current detector 104 is not limited thereto, and other means can be used alternatively, provided that it can detect current values. The voltage of the power supply 103 is measured by a voltage detection means 108, and its detected voltage $V_{103}$ is sent to a control unit 102. The current flowing into the first coil 100 and the second coil 101, or the sum of the currents flowing into both coils, is measured by the current detector 104, and the results are sent to the control unit 102. Although not shown in the figure, operational status information, such as the internal-combustion engine speed, is also input to the control unit 102.

Inside the control unit 102, an injection command pulse corresponding to the amount of fuel injection required according to a particular operational status of the internal-combustion engine is created, and a signal for controlling the changeover between the first switch 105, the second switch 106, and the third switch 107, is output, based on that injection command pulse.

A certain voltage judgment reference value ($V_{th}$) is provided for the voltage detection value that has been measured by the voltage detection means 108 of the power supply 103. The fuel injector operation and the switch opening/closing operations, which are controlled on the basis of whether the voltage detection value is greater or less than the voltage judgment reference value, will be described below with reference to FIG. 3.

When, as shown in FIG. 3(A), an injection command pulse signal 110 turns on at "$t_0$", the control unit 102 outputs a control signal, as shown in FIG. 3(C), for connecting the first switch 105, the status of which is represented by numeral 117; and, as shown in FIG. 3(D) and FIG. (E), it outputs control signals for disconnecting the second switch 106 and the third switch 107, the status of which is represented by numerals 118 and 119, respectively. Thereby, the first coil 100 and the second coil 101 are connected in series to the power supply 103. The resultant inductance produced by the series connection of the first coil 100 and the second coil 101, when viewed from the power supply 103, increases.

The voltage at both ends of the series-connected first coil 100 and second coil 101, namely, the voltage between points A and D, takes the waveform 111 shown in FIG. 3(B). Here, the current flowing through the series-connected first coil 100 and second coil 101, namely, the current I flowing between points A and D, can be caused to rapidly increase by appropriately setting the relationship between the voltage and the resultant inductance and resistance value of the coils. Accordingly, the magnetomotive force (ampere-turns), which is the product of this current value and the total number of turns of the first coil 100 and second coil 101, also rapidly increases. This state is shown by the curve 112 in FIG. 3(F).

Since the magnetic attraction force exerted on the valve body 4 also increases rapidly, the displacement thereof takes the form shown by curve 113 in FIG. 3(G), thus causing the valve to open at high speed. After a fixed time, that is to say, after the elapse of time T, as shown in FIG. 3(F), the control unit 102 generates a control signal for repeating the disconnection and connection of the first switch 105 so that the magnetomotive force becomes a relatively low retention magnetomotive force (fh).

After that, when the fuel injection command pulse turns off at "te", the control unit 102 generates a control signal for disconnecting the first switch 105. Since the coil current disappears, the valve body returns to a valve-closing position. Under this operation sequence, the amount-of-injection characteristics, as represented with the fuel injection command pulse width taken on the abscissa and the amount of fuel injection taken on the ordinate, appear as a fuel injection characteristics curve 120 shown in FIG. 4.

However, the voltage of the power supply 103 frequently changes. In particular, when a battery for an automobile is employed as the power supply 103, the voltage could decrease to about 6 V, as represented by numeral 114 in FIG. 3(B). In other words, the voltage may change to a value smaller than the voltage judgment reference value $V_{th}$.

At this time, supposing that the resultant inductance of the coils is great, as described above, since the current flowing through the coils would also decrease, the response characteristics of the magnetomotive force would decrease, taking the form as denoted by numeral 115 in FIG. 3(F). Because of the lack of magnetomotive force (ampere-turns), the displacement of the valve would take a form as denoted by numeral 116 in FIG. 3(G), thus making valve opening incomplete. In extreme cases, the fuel injection valve might not open at all.

Figures 4, 6:
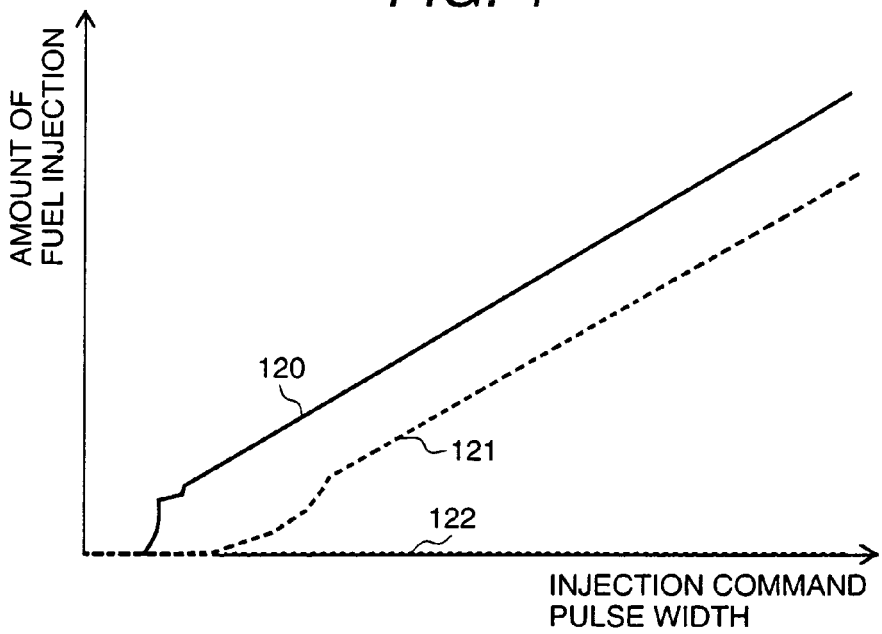
FIG. 4 is a diagram showing the relationship between the fuel injection pulse and the amount of fuel injection.
FIG. 6 is a table showing the operation of the changeover switches of the fuel injector according to the present invention, as well as the connection relationship between coils.

More specifically, the amount-of-injection characteristics of the fuel injection valve might appear as the characteristics curve 121 or 122 shown in FIG. 4. In other words, even if the same injection command pulse width is assigned, the amount of fuel injection would decrease. If this is the case, since the amount of fuel injection required for the particular operational status of the internal-combustion engine cannot be supplied, a problem will be caused in the operation of the internal-combustion engine. Under this operation sequence, the amount-of-injection characteristics, as represented with the fuel injection command pulse width taken on the abscissa and the amount of fuel injection taken on the ordinate, would change from the characteristic 120 shown in FIG. 4 to the characteristics 121 or 122.

Figure 5:
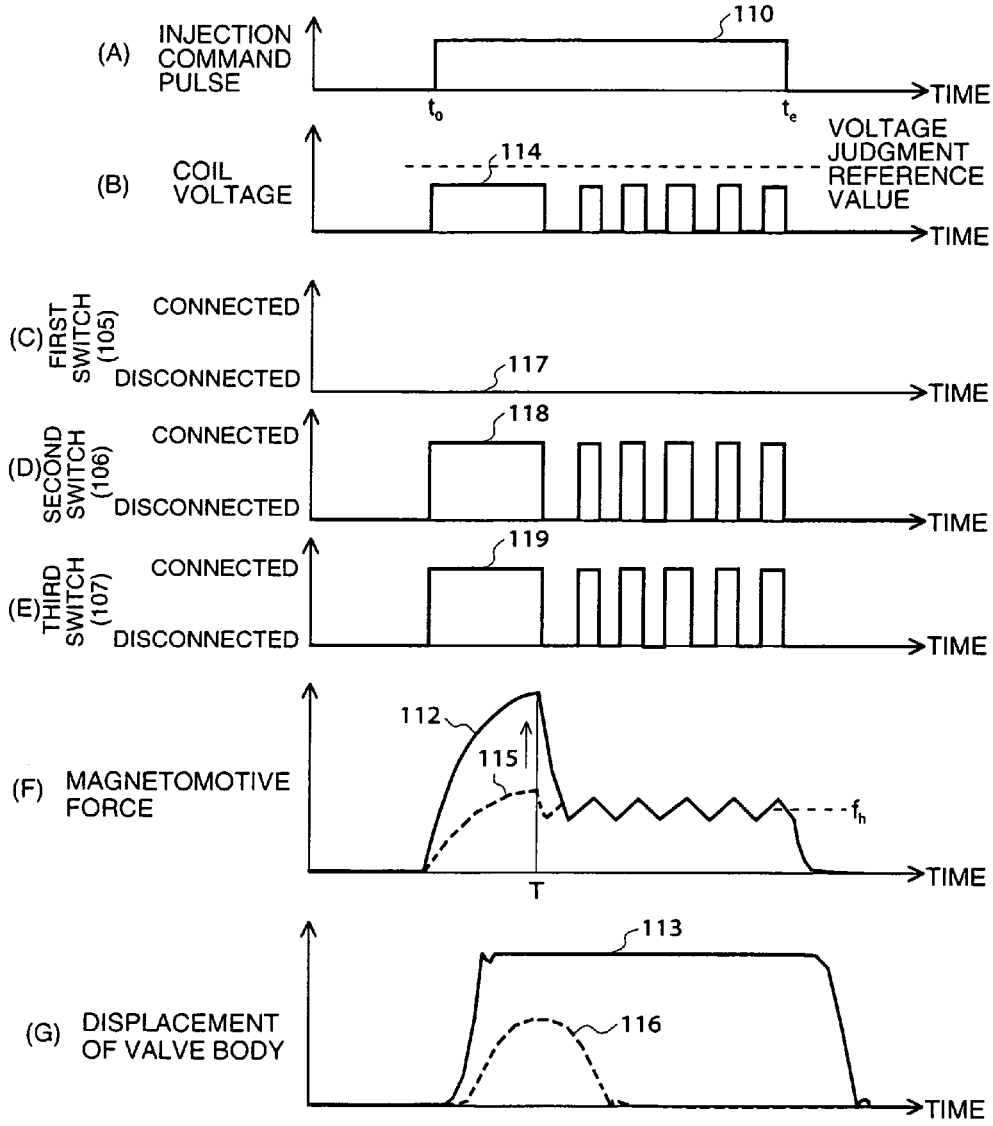
FIG. 5 is another timing chart illustrating the operation of the fuel injector according to the present invention.

In order to solve this problem, the considerations described below are incorporated into the present embodiment. The operation of the fuel injector, when the voltage value of the power supply 103 is smaller than the above-mentioned voltage judgment reference value $V_{th}$, will be described below with reference to FIG. 5.

When the battery voltage $V_{103}$ is such that $V_{103} \leqq V_{th}$, and the injection command pulse 110 turns on at "$t_0$", as seen in FIG. 5(A), the control unit 102 outputs a control signal 117 for disconnecting the first switch 105, as seen in FIG. 5(C), and it outputs control signals 118 and 119 for connecting the second switch 106 and the third switch 107, as seen in FIG. 5(D) and FIG. 5(E). Thus, the first coil 100 (N1) and second coil 101 (N2) shown in FIG. 1 are connected in parallel to the power supply 103.

Accordingly, the resultant inductance produced by the parallel connection of the first coil 100 and the second coil 101, when viewed from the power supply 103, will be reduced. Since a high-speed response of the magnetomotive force can now be obtained, it becomes possible to obtain a magnetomotive force waveform 112 as seen in FIG. 5(F). Consequently, as represented by numeral 113 in FIG. 5(G), the displacement of the valve body can be fast and stable.

After a fixed time, that is to say, after the elapse of time T, as shown in FIG. 5(F), the control unit 102 generates a control signal for repeating the disconnection and connection of the second switch 106 and third switch 107 so that the total magnetomotive force becomes a relatively low retention magnetomotive force (fh).

To control the retention magnetomotive force "fh" by connecting the two coils in parallel, it is preferable that the current value of the current detector 104 should be controlled so as to be about twice the current value thereof obtained in the case of a series connection of the coils.

When the fuel injection command pulse turns off, the control unit 102 generates a control signal for disconnecting the second switch 106 and the third switch 107, thereby making the coil current disappear and returning the valve body to a valve-closing position.

Here, the series/parallel connection relationship caused by control of the first switch 105, the second switch 106 and the third switch 107, between the first coil 100, and the second coil 101, is arranged in order. This arranged state of the relationship is shown in FIG. 6. When $V_{103}>V_{th}$, this denotes a normal status. Conversely, when $V_{103}\leqq V_{th}$, changeover control is conducted for the switches, since the power supply voltage is judged to be too low.

In this way, providing the judgment reference value $V_{th}$ for the changeover of the switch connection makes it possible to switch the series/parallel connection of the first coil and the second coil when the power supply voltage becomes equal to, or less than, the above reference value. It becomes possible, by doing so, to obtain the same valve-opening characteristics in a low battery state as those obtained in the case of a normal battery state. This status is shown by solid lines in FIG. 3(F) and FIG. 3(G) and FIG. 5(F) and FIG. 5(G). Therefore, stable injection characteristics can be obtained without changes in the fuel injection characteristics 120 of FIG. 4.

Figure 7:
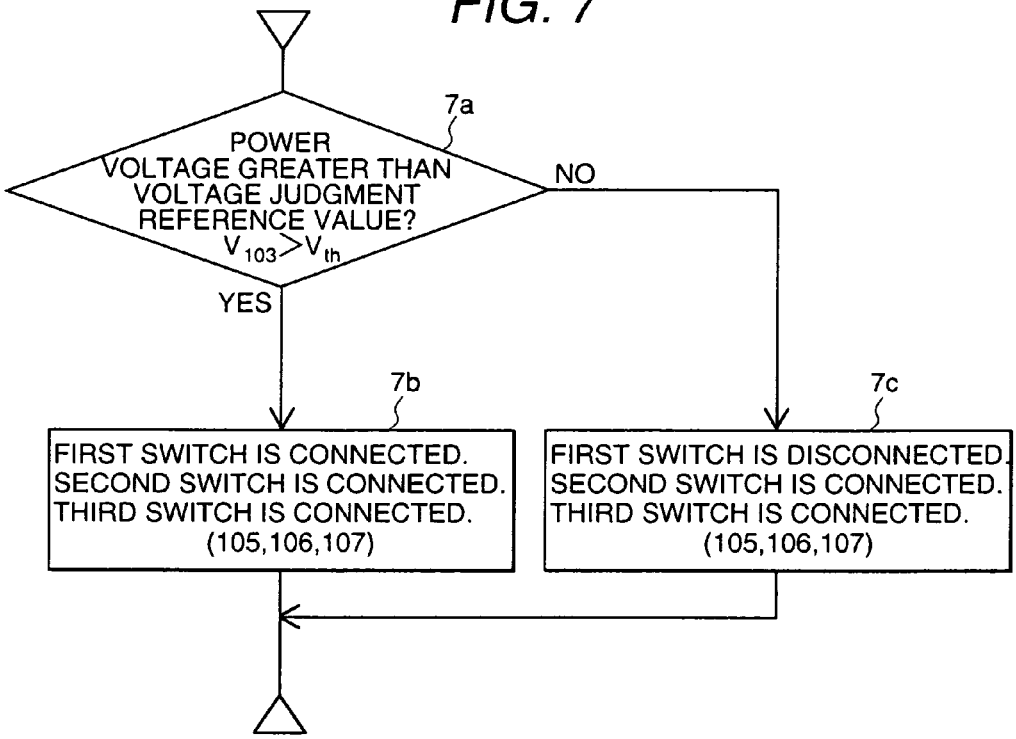
FIG. 7 is a flowchart showing the fuel injector of the present invention.

The process carried out flow in the control unit 102 is shown in FIG. 7. In step 7*a*, it is judged whether the power supply voltage $V_{103}$ or the voltage judgment reference value $V_{th}$ is greater. If the relationship of $V_{103}\leqq V_{th}$ holds, parallel connection between the first coil 100 and the second coil 101 is effected in step 7*c*. That is to say, the connection is changed by turning off the first switch 105 and turning on the second switch 106 and the third switch 107. See FIG. 6. Conversely, when $V_{103}>V_{th}$, this status is judged to be normal and the coils remain connected in series, as shown in step 7*b*. Also, see FIG. 6.

Under this operation sequence, the amount-of-injection characteristics, as represented with the fuel injection command pulse width taken on the abscissa, and the amount of fuel injection taken on the ordinate, take the form shown by 120 in FIG. 4, and regardless of a low-voltage status, it becomes possible to maintain a status as stable as the fuel injection characteristics that are obtained when the voltage is high. More specifically, even when the power supply voltage changes, it becomes possible to suppress changes in the amount of fuel injection with respect to the same injection command pulse width, and thus to always stabilize the amount of injection. Hereby, the proper amount of fuel injection according to the particular operational status of the internal-combustion engine can be supplied, and this, in turn, enables stabilized operation of the internal-combustion engine.

Next, the relationship between power supply voltage changes and the fuel injection characteristics will be described with reference to FIG. 8. Suppose that the normal power supply voltage $V_{103}$ is 14 v. The amount of fuel injection at this time is expressed as Fn. A case in which this power supply voltage $V_{103}$ decreases to 7.0 (v) will be considered by way of example. In this case, when $V_{th}$ is set to 7.0 (v), the connection between the first coil 100 and the second coil 101 is changed at this time. More specifically, a coil changeover signal is output from the control unit 102 and the connection between the first coil 100 and the second coil 101 is changed from series connection to parallel connection. If both coils remain connected in series at $V_{103}$=7.0 (v), the amount of fuel injection decreases to F1 (<Fn). The amount of injection, however, can be recovered to the vicinity of Fn by changing the connection of the coils, to a parallel connection.

Figure 8:
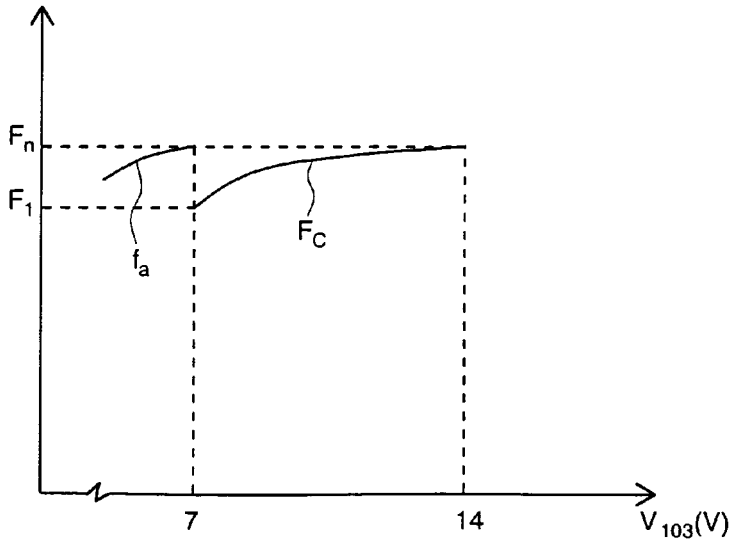
FIG. 8 is a diagram showing the relationship between changes in power supply voltage and changes in the amount of fuel injection.

FIG. 8 shows an example in which the connection between the coils is changed when $V_{103}$=7.0 (v). However, an optimum value needs to be set since the characteristics in FIG. 8 change according to the fuel injection characteristics relative to the power supply voltage, more particularly, according to the characteristics of the fuel injection valve.

In general, it is desirable that, when the voltage $V_{103}$ decreases to a range from about 7.0 to 9.0 (v), the connection between the coils should be changed. Or conversely, after the tolerance of changes in the amount of fuel injection has been determined, the above-described changeover control can be conducted when the tolerance is reached. For example, since characteristics "Fc" exhibit nonlinearity with respect to changes in the power supply voltage, when the power supply voltage decreases to half its original value, "F1=(½)Fn" does not always hold. Therefore, the connection between the coils 100 and 101 can also be changed when the condition of "(Fn−Fc)>Fg (required value)" is established.

In general, changes in the voltage of the power supply 103 cannot be avoided. In particular, when an automotive battery is employed as the power supply 103, the voltage could decrease to about 6 V, as represented by numeral 114 in FIG. 3(B). At this time, if the resultant inductance of the coils is great, as described above, the response characteristics of the magnetomotive force are apparently tantamount to having decreased, and the magnetomotive force takes a form as denoted by numeral 115 in FIG. 3(F). Because of the lack of magnetomotive force, the displacement of the valve takes a form as denoted by numeral 116 in FIG. 3(G), thus making valve opening incomplete.

The amount-of-injection characteristics appear as a characteristics curve 121 or 122 in FIG. 6, and thereby, there occur changes in the amount of fuel injection with respect to the same injection command pulse width. Since the amount of fuel injection according to the particular operational status of the internal-combustion engine cannot be supplied, a problem will be caused in the operation of the internal-combustion engine.

Also, it would be possible to use the following methods to judge whether the power supply voltage $V_{103}$ or the voltage judgment reference value $V_{th}$ is greater. The methods that can be actually used, however, are not limited to these methods: for example, the relationship in magnitude between the power supply voltage value and the voltage judgment reference value can be judged by converting a detected voltage value into digital signal form by means of an A/D converter provided in either the voltage detection means 108 or the control unit 102, and then using a microcomputer provided in the control unit 102 to detect the relationship. Or, the relationship in magnitude can be judged by supplying the power voltage value and the voltage judgment reference value to a comparator.

In addition, there is another method of ensuring that the valve will open even when the power supply voltage decreases. As described above, when the power supply voltage decreases, the rise of the magnetomotive force apparently is reduced, as shown in 115 of FIG. 3(F), and, therefore, it may not be possible to obtain the magnetomotive force actually required to open the valve. At this time, by increasing the value of T, which is the time for increasing the magnetomotive force to a retention magnetomotive force, the time during which the magnetomotive force increases can likewise be adjusted so that there is sufficient time for the magnetomotive force to become great enough to open the valve. This method is also valid for ensuring valve opening.

However, since this method extends the time required for the magnetomotive force to become great enough to open the valve, the amount-of-injection characteristics are likely to take the form represented by numeral 121 in FIG. 4. For this reason, a change in the amount of fuel injection will occur corresponding to the same injection command pulse width. Of course, it is also possible, after estimating this spread of change, to provide control so that the injection command pulse width is adjusted.

To simplify engine control, however, it is desirable that the amount of fuel injection corresponding to the same injection command pulse width should always be constant. The present embodiment is advantageous in that the amount of fuel injection corresponding to the same injection command pulse width is always constant.

Furthermore, there is yet another method of ensuring that of the valve will open even when the power supply voltage decreases. That is to say, valve opening can be achieved by applying a voltage only to either the first coil 100 or the second coil 101 when the power supply voltage decreases. This method can also be effective when a voltage is applied only to a portion of the coil-wound section of the fuel injection valve. The use of this method also makes it possible to reduce the resultant inductance of the coils when viewed from the power supply 103, and, thereby, to augment the magnetomotive force abruptly. However, since the magnetomotive force is consequently applied to only a portion of the coil space of the fuel injection valve, the current density increases and this poses the problem that the coil temperature increases very significantly.

In the present embodiment, however, since a magnetomotive force is applied to the entire coil space of the fuel injection valve, and since the current density is controlled to a relatively small value, there is the advantage that increases in the coil temperature can be minimized.

Next, the strand diameters and number-of-turns of the first coil 100 and second coil 101 in the present embodiment will be described. It is desirable that the first coil 100 and the second coil 101 should have the same strand diameter and the same number of turns. In this case, the responsiveness of the magnetomotive force can be controlled to the same level between both coils, even if the power supply voltage decreases to about half its original value.

However, even if the strand diameters and number-of-turns of the first coil 100 and second coil 101 are set to different values, the resultant inductance of the two coils still can be reduced by connecting both coils in parallel, and the effects of the present invention are not degraded.

Figure 3:
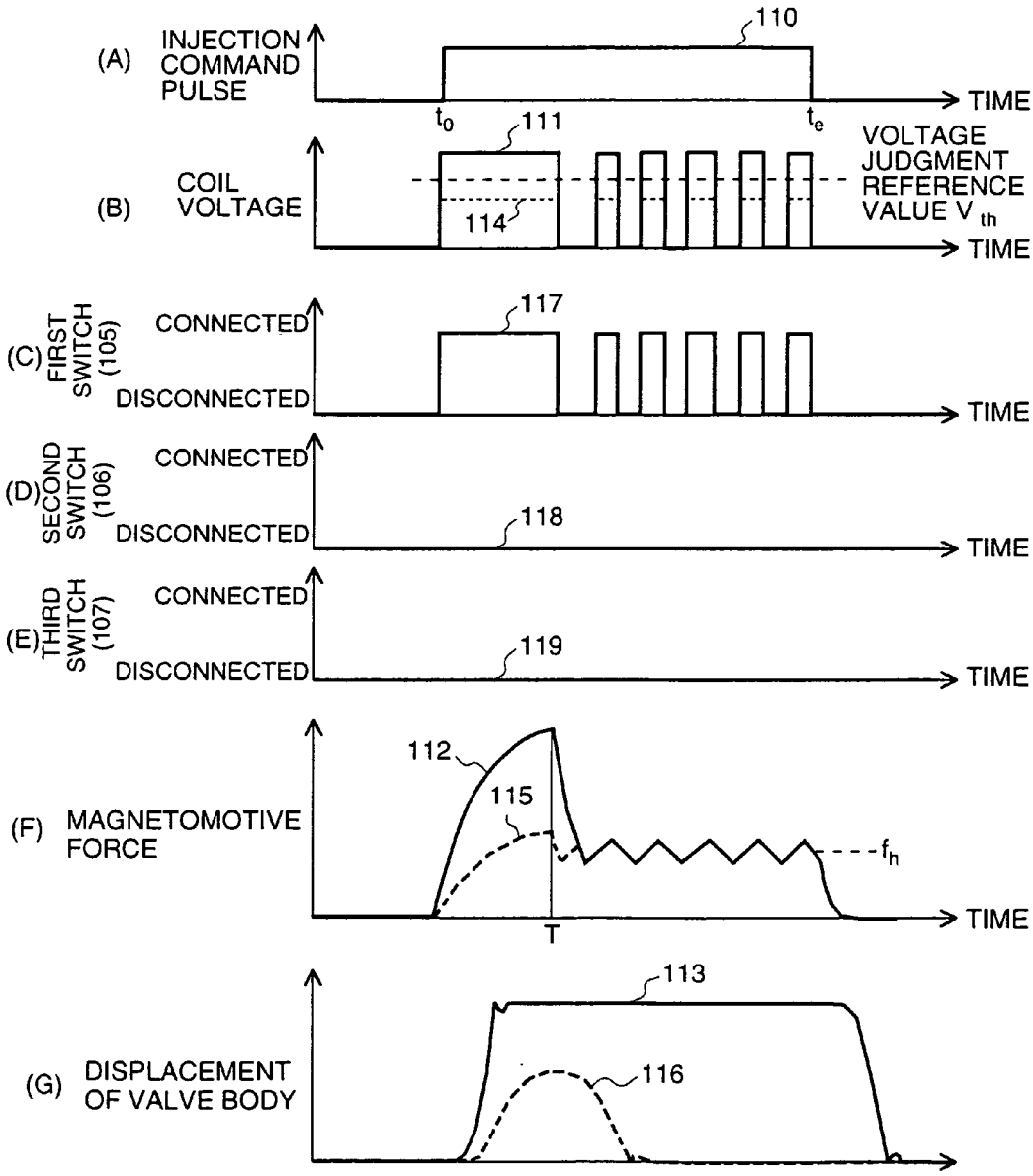
FIG. 3 is a timing chart illustrating the operation of the fuel injector according to the present invention.

For the present embodiment, as shown in FIG. 3, the scheme in which the magnetomotive force is changed to a retention magnetomotive force has been described. The effects of the present invention can likewise be obtained by adopting a scheme in which, after a reference value has been provided for the maximum magnetomotive force beforehand, the magnetomotive force is changed to a retention magnetomotive force at the time of detection of the fact that this reference value has been reached.

Figure 9:
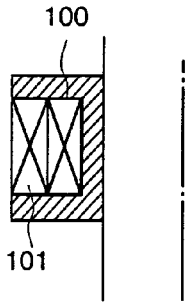
FIG. 9 is a diagram showing another embodiment of the present invention.

In the present embodiment, as shown in FIG. 2, the first coil 100 and the second coil 101 are arranged adjacent to each other in the axial direction of the fuel injection valve. It is also possible to adopt a coil arrangement in which the first coil 100 is disposed at the inside-diameter side of the fuel injection valve and the second coil 101 disposed at the outside-diameter side. This is a method of arranging the two coils radially, not axially, with respect to the fuel injection valve. It is advantageous to adopt this method in a case in which, for example, there are spatial margins in the radial direction of the fuel injection valve, rather than in the axial direction thereof. A schematic view of such an arrangement is shown in FIG. 9.

Furthermore, although a method of electrical connection between the first coil 100, the second coil 101 and the power supply 103, has been shown in FIG. 1, the electrical connection method, the number of switches, the number of coils, and other factors are not limited by the example shown FIG. 1.

Figure 10:
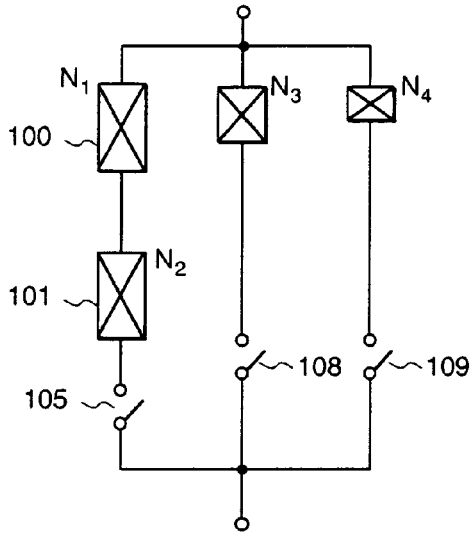
FIG. 10 is a schematic circuit diagram showing yet another embodiment of the present invention.

When three or more coils are provided, so long as the connection status of these coils, when viewed from the power supply can be changed from series connection to parallel connection, or vice versa, the present invention can also be applied in that case. An example of a multiple coil arrangement in such a case is shown in FIG. 10. In this example, N1 and N2 are the same as coils 100 and 101 in FIG. 1. These two coils are connected in series to a switch 105, and parallel connection thereof is omitted. Additional coils N3 and N4 are connected to switches 108 and 109, respectively.

Also, in the above-described embodiment, although a method of changing the resultant inductance has been described based on an example in which the power supply voltage changes, the response of the current may also deteriorate if changes in resistance occur in the coils or in the electrical wiring (namely, harness) for supplying the current to the coils. If that is the case, the amount-of-injection characteristics can be stabilized by, for example, detecting the resistance values directly or indirectly and then increasing or reducing the resultant inductance, depending on the resistance values, by use of the method described above.

Figure 11:
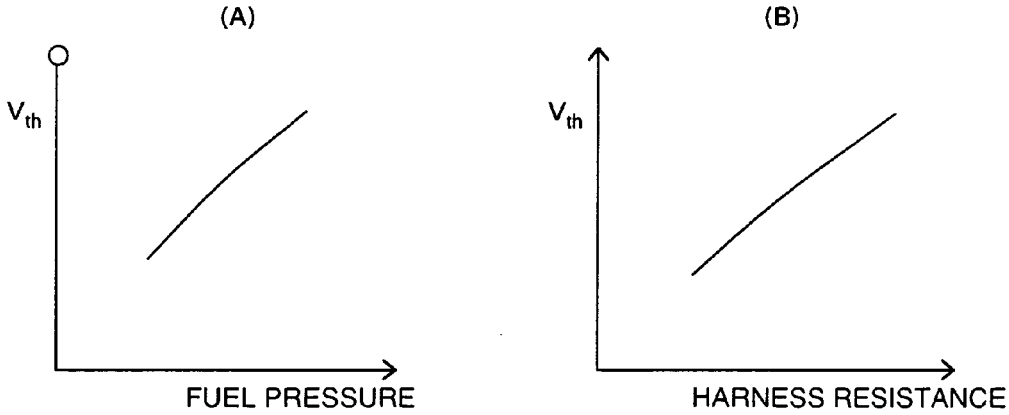
FIGS. 11A and 11B are graphs that show examples in which $V_{th}$ is varied according to a particular fuel pressure or a particular resistance value of the harness, respectively.

Referring to the example of FIG. 1, it has been earlier described that when a battery supplying a voltage of 14 (V) is used, the appropriate voltage judgment reference value $V_{th}$ for series/parallel connection changeover of the coils is from 7 to 9 (V). The voltage judgment reference value $V_{th}$, however, can be varied according to other conditions. For example, $V_{th}$ can be varied according to a particular fuel pressure or the particular resistance value of the harness. Examples are shown in FIGS. 11(A) and 11(B). FIG. 11(A) shows an example in which the voltage judgment reference value $V_{th}$ is varied according to the fuel pressure. FIG. 11(B) shows an example in which the voltage judgment reference value $V_{th}$ is varied according to particular changes in the resistance value of the harness.

Furthermore, it may be advisable to vary the responsiveness of the magnetomotive force according to a particular fuel pressure level. For example, when the fuel pressure is high, it may be possible for the opening of the valve to be stabilized by reducing the responsiveness of the magnetomotive force. In this case, the amount-of-injection characteristics can be stabilized by detecting the fuel pressure directly or indirectly and then increasing or reducing the resultant inductance, depending on that pressure value, by use of the method described above.

In addition, the effects of the present invention are not limited to the use of a fuel injection valve having a composition as shown in FIG. 2. The effects of the present invention can be obtained for any type of fuel injector, provided that the fuel injection valve has coils and a magnetic circuit is included in the fuel injector.

According to the present invention, even in the case of power supply voltage changes or the like, it is possible to operate the valve body at high speed and stably, thereby to stably maintain the amount of fuel injection with respect to the same injection command pulse width and, consequently, to obtain a fuel injector that can stabilize the operational status of an internal-combustion engine. According to the present invention, the amount of injection is stably maintained, even when power supply voltage changes occur.

The present invention can be used for an electromagnetic valve of the type that uses an electromagnetic force to provide fuel supply control, as well as for an automotive fuel injection valve.

What is claimed is:

1. A fuel injector system comprising:

a direct-current power supply, a power supply voltage detection means, a coil-equipped fuel injection valve, and a control unit for controlling said fuel injection valve; wherein said fuel injection valve has a plurality of coils, and said control unit outputs a changeover signal for changing the magnitude of the resultant inductance of the plurality of coils of said fuel injection valve in accordance with a power supply voltage detection value sent from said power supply voltage detection means, wherein said fuel injection valve has at least two coils, and said control unit outputs a connection changeover signal for connecting said plurality of coils in parallel to set the resultant inductances thereof to small values and for changing said plurality of coils to a series connection to obtain large resultant inductance values.

2. The fuel injector of claim 1, wherein said control unit sets a reference value of a power voltage and outputs a changeover signal by which, when a value that has been detected by said power supply voltage detection means is less than said reference value, said coils are reduced in resultant inductance, and when the power supply voltage detection value is greater than said reference value, said coils are increased in resultant inductance.

3. The fuel injector of claim 2 or 1, wherein said control unit outputs said changeover signal to control the resultant inductance of the plurality of coils of said fuel injection valve when a power supply voltage reference value that has been set beforehand is reached.

4. The fuel injector of claim 2 or 1, wherein said control unit effects control so that a current is supplied to said plurality of coils of said fuel injection valve by constant-current limitation.

5. A control method for use in a fuel injector system which comprises:

a direct-current power supply, a power supply voltage detection means, a fuel injection valve with at least two coils, and a control unit for controlling said fuel injection valve; wherein said control method comprises the steps of:

detecting that a voltage detected by said power supply voltage detection means has decreased to a value that has been set beforehand;

creating a connection changeover signal of at least said two coils in response to said detection changing the connection of the coils to reduce the resultant inductance thereof, and conducting control so that the time-varying characteristics of total magnetomotive force are approximately maintained at the characteristics existing before the power supply voltage decreased.

* * * * *